US006232995B1

(12) United States Patent
Schartner

(10) Patent No.: US 6,232,995 B1
(45) Date of Patent: May 15, 2001

(54) COLOR PRINTER HAVING A PRINTING FILM CONSERVING MECHANISM

(75) Inventor: Zachery J. Schartner, Narragansett, RI (US)

(73) Assignee: Astro-Med, Inc., West Warwick, RI (US)

( * ) Notice: Subject to any disclaimer, the term of this patent is extended or adjusted under 35 U.S.C. 154(b) by 0 days.

(21) Appl. No.: 09/514,799

(22) Filed: Feb. 29, 2000

Related U.S. Application Data

(63) Continuation of application No. 09/300,067, filed on Apr. 27, 1999, now Pat. No. 6,031,555.

(51) Int. Cl.[7] ..... B41J 11/20
(52) U.S. Cl. ..... 347/220; 400/648; 400/649
(58) Field of Search ..... 347/220, 197; 400/648, 649

(56) References Cited

U.S. PATENT DOCUMENTS 4,228,441 10/1980 Rhine .
4,480,933 11/1984 Shibayama et al. .
4,507,666 3/1985 Kondo et al. .
4,669,896 6/1987 Yokota et al. .
4,844,632 7/1989 Minowa .
4,949,098 8/1990 Gluck et al. .
5,064,300 11/1991 Kashiwaba .
5,206,662 4/1993 Fox et al. .
5,372,439 12/1994 Poole et al. .
5,505,550 4/1996 Kitahara et al. .
5,648,811 * 7/1997 Thiel et al. ..... 347/220
5,675,369 10/1997 Gaskill .
6,031,555 * 2/2000 Schartner ..... 347/197

FOREIGN PATENT DOCUMENTS 61-20775 * 1/1986 (JP) .

* cited by examiner

*Primary Examiner*—Huan Tran
(74) *Attorney, Agent, or Firm*—Salter & Michaelson

(57) ABSTRACT

A printing assembly for use with a printing device as provided. The printing assembly includes an adjustable platen assembly including a platen having a jack member constructed and arranged to adjustably maintain the platen in parallel relation to a print head when the print head is in a first position, so as to prevent deformities in the printed image as an article passes through the printing assembly.

15 Claims, 6 Drawing Sheets

COLOR PRINTER HAVING A PRINTING FILM CONSERVING MECHANISM

This application is a Continuation of Ser. No. 09/300,067, filed Apr. 27, 1999 now U.S. Pat. No. 6,031,555.

BACKGROUND OF THE INVENTION

1. Field of the Invention

The present invention generally relates to multi-color printing devices and, more particularly, to a multi-color printing device which saves printing film by only applying a particular color to the printing medium when that color is needed for printing on the medium.

2. Discussion of the Related Art

Currently available thermal transfer printing heads generally comprise a plurality of thermal elements. The heating elements are generally provided on one side of a flat substrate of ceramic or like material along with the requisite electronic circuitry for controlling the activation of the heating elements.

The thermal transfer printing head is typically used in conjunction with a roller platen assembly and ink transfer printing film or ribbon which carries a thermally transferable printing ink. During printing, a web of material to be printed are oriented between the thermal elements of the printing head and the roller platen of the roller platen assembly such that the printing ribbon is adjacent to the print head and the material to be printed is adjacent to the roller platen. The roller platen and printing head are moved against each other so that the printing ribbon and the material to be printed are pressed against the printing head such that when selected thermal elements of the printing head are heated, ink from the ink transfer printing ribbon is transferred to the surface of the material.

Typical thermal transfer printers can include one or more printing heads, each of which are capable of printing in a different color. If more than one printing head is employed, the printing heads are generally arranged in line with each other, with each printing head having a roller platen assembly associated therewith.

In typical multi-color thermal transfer printers, each printing head and roller platen assembly is associated with a printing film of a particular color. During the printing process, the media to be printed is passed between the head and roller platen of each roller platen assembly along with the printing film of each assembly. For simplicity, the printing media referred to in this application is a series of labels serially attached on a continuous web. When a particular color is to be printed on a label, the printing head is activated, thus transferring the ink from the film to the label.

In one type of prior art thermal transfer printer, the film is wound off of a supply roll and through the roller platen assembly at the same rate that the label web is fed through the assembly. While this ensures that a fresh portion of printing film is always in contact with the label when the printing head is activated, it also wastes a great deal of the film, especially if a particular color is used sparingly for a particular print job. Since the label web and the printing films are fed through the printing apparatus at a 1:1 ratio, for each length of a label, an identical length of printing film is used. Therefore, in a system which uses four printer assemblies to print four colors on a label, for each label printed, four times as much film is used.

In an attempt to reduce the amount of film used in this printing process, prior art printing devices have been developed in which the printing head of a particular printing assembly is lowered against the roller platen only when the particular color associated with that printing assembly is to be applied to the printing media. When the color is not being applied, the printing head is raised away from the roller platen. Therefore, the printing film is only fed through the printing assembly while that particular color is being printed. While this type of device effectively reduces the amount of film used, it presents other problems. Specifically, when the printing head is mechanically urged downward onto the roller platen, by, for example, a motor-powered drive mechanism, the impact of the printing head against the roller platen causes printing irregularities, such as smudging, blurring and color darkness inconsistencies. Furthermore, the impact of the printing head against the roller platen shortens the effective life of the printing head.

Therefore, what is needed is a printing mechanism which conserves the amount of printing film used for a particular printing process, while also reducing printing errors which can occur in the prior art printing mechanisms.

SUMMARY OF THE INVENTION

The present invention provides a printing device in which the printing head of a printing apparatus is biased against the associated roller platen for transferring ink from a printing film to a label mounted on a media web as it passes between the printing head and the roller platen. At the instances when ink is not to be transferred onto the label, the print head is pushed away from the roller platen to stop the transfer of ink to the label. When printing is to resume, the print head is controllably released to allow it to come into contact with the roller platen, thus causing ink to be transferred to the label. In this manner, since the print head is brought into contact with the roller platen in a controlled manner, the printing inconsistencies associated with the prior art printing devices are eliminated.

According to one embodiment of the invention, an apparatus for applying images to a strip of print media is disclosed. The apparatus comprises a printing mechanism having a platen and a thermal print head mounted on a mounting bar, for biased engagement with the platen, the strip passing intermediate the thermal print head and the platen, a thermal printing film passing intermediate the strip and the thermal print head and a print head lifting mechanism which is movable between a first position, in which the print head lifting mechanism is disengaged from the mounting bar, thereby allowing the print head to be biased into engagement with the platen, and a second position, in which the head lifting mechanism engages the mounting bar, thereby lifting the print head out of engagement with the platen. The mounting bar is biased toward the platen by a spring mechanism which applies a constant biasing force to the mounting bar, thereby biasing the print head into engagement with the platen with the constant biasing force.

The head lifting mechanism comprises at least one finger mounted on a shaft and an actuation device, the activation device being operative for rotating the shaft to move the at least one finger between the first position and the second position. The actuation device is a piston which, when activated, rotates the shaft to move the at least one finger from the second position to the first position, and which, when deactivated, rotates the shaft to move the at least one finger from the first position to the second position.

Other features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION

Figure 1:
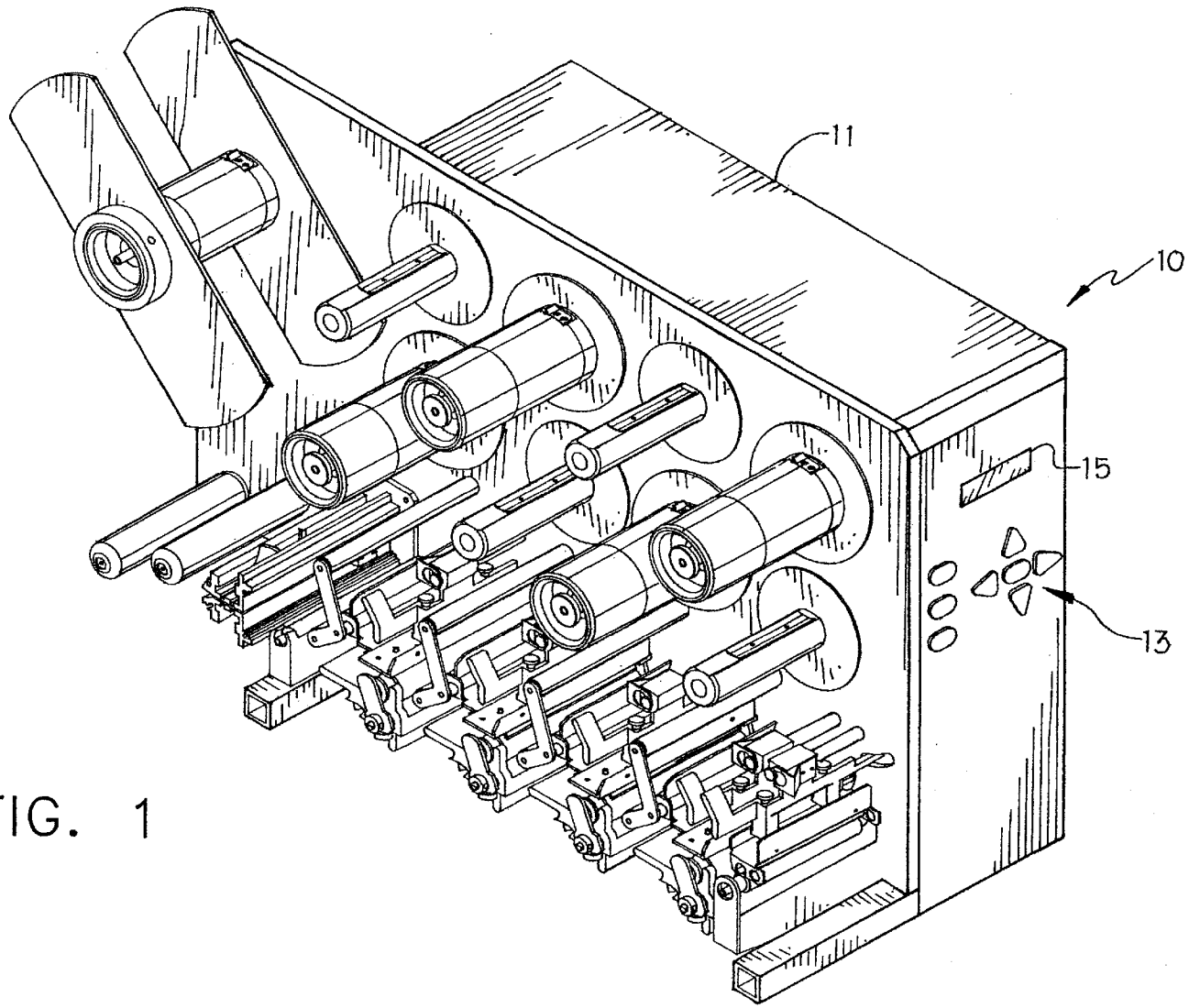
FIG. 1 is a perspective view of the printing apparatus of the present invention.
Figure 2:
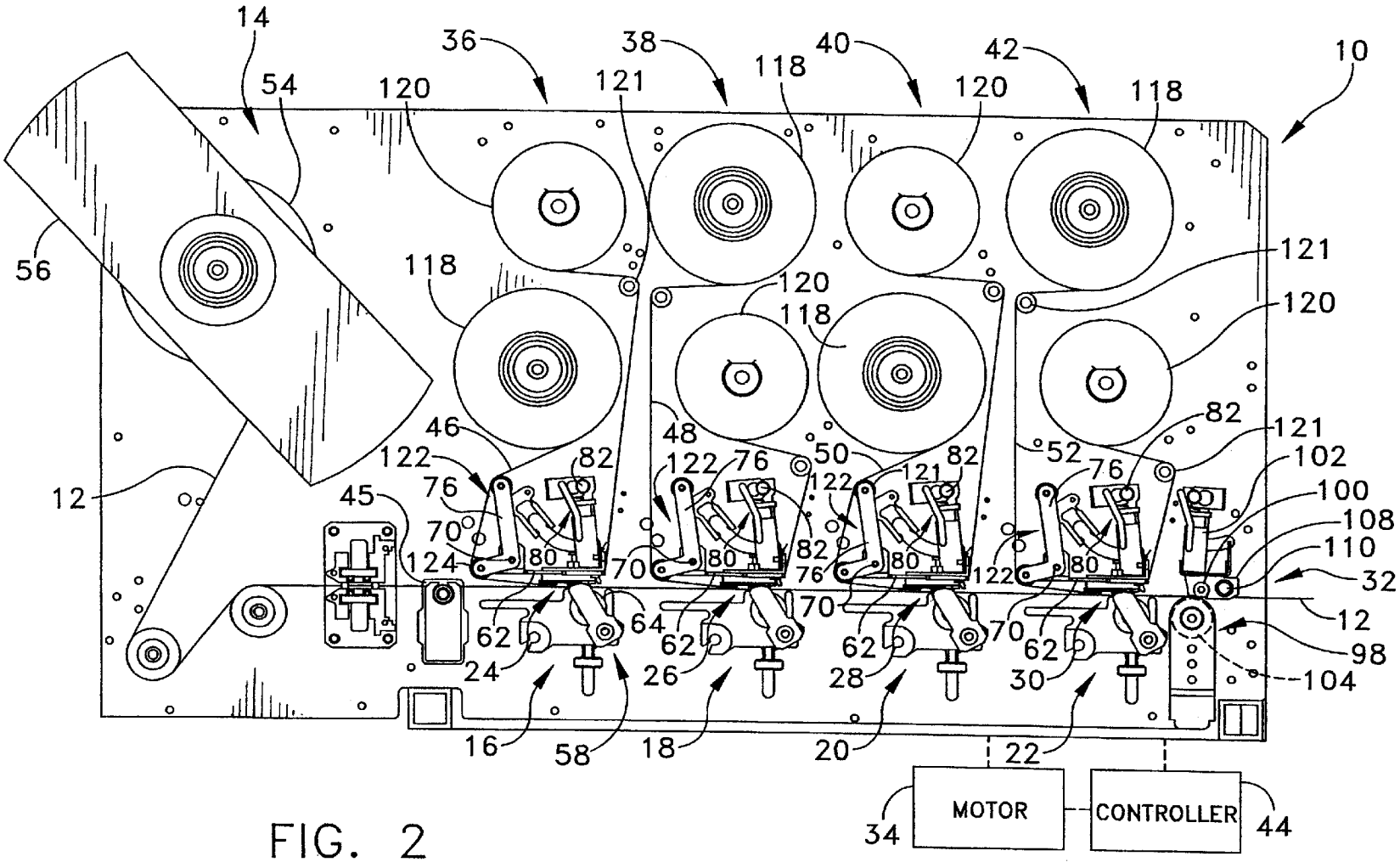
FIG. 2 is a front view of the printing apparatus of the present invention, showing the four printing assemblies in the actuated position.
Figure 3:
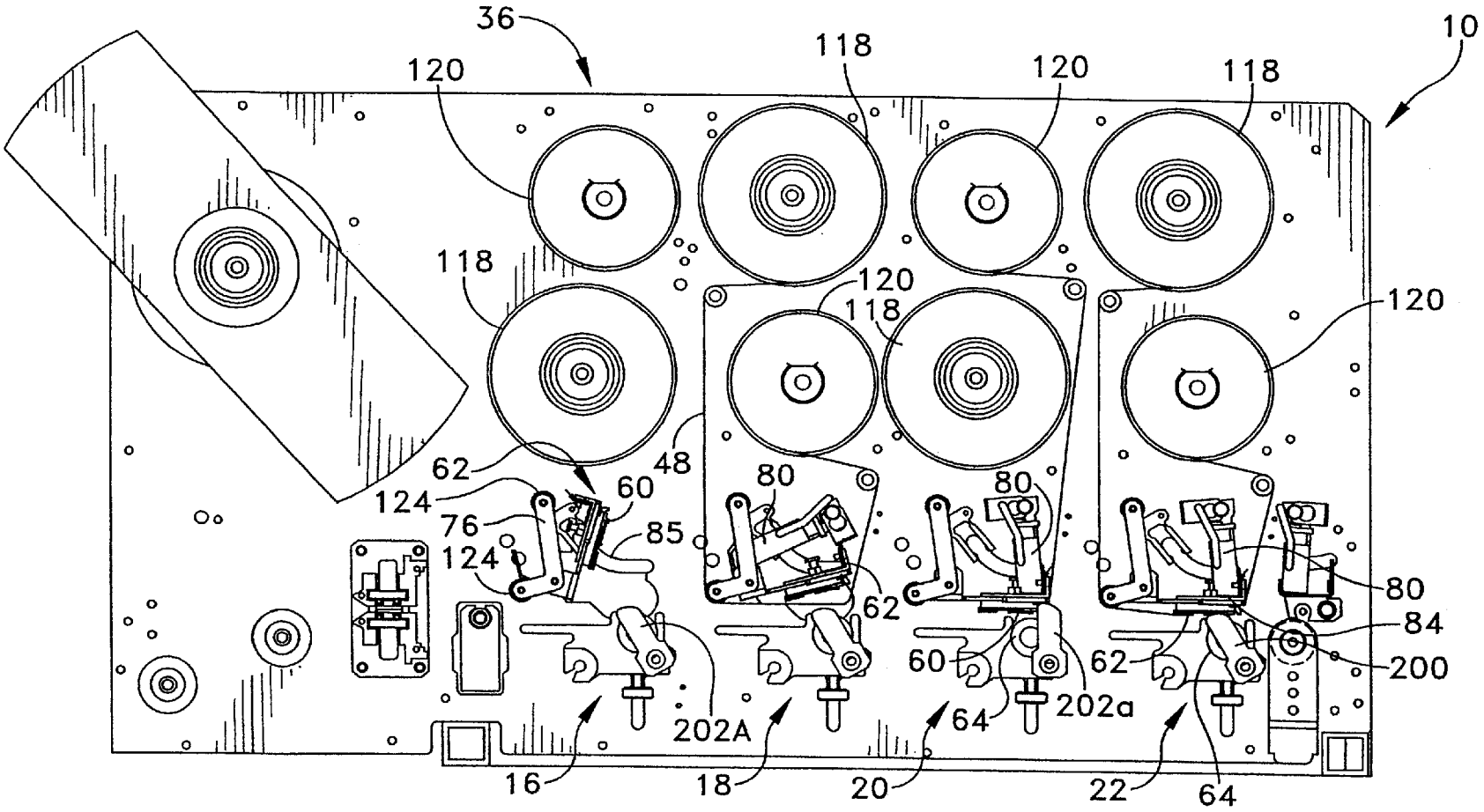
FIG. 3 is a front view of the printing apparatus of the present invention, showing each of the four printing assemblies in a different position.

Referring now to the drawings, there is generally indicated at 10 in FIGS. 1–3, a printing device which embodies the printing assembly of the present invention. The printing assembly is shown removed from the printing device 10 in FIGS. 4–7. FIG. 1 is a perspective view of a printing device 10 which is capable of respectively printing multiple colors on printed articles which are serially connected together or mounted on a carrier media web 12. For simplicity, the printed articles on which the present invention will be described as printing are adhesive labels which are serially mounted on a web 12. However, it will be understood that any type of suitable article may be printed on using the printing apparatus of the present invention.

Printing device 10 includes a housing 11 for enclosing certain mechanical devices associated with the device 10, including a stepping motor 34 and a controller 44 (both shown schematically in FIG. 2) for controlling the operation of the printing device 10. The controller 44 includes electronics known in the art and therefore, they will not be described. Housing 11 includes a control panel including a number of control buttons 13 for programming and controlling the printing device 10, as well as a display unit 15 for indicating an operation mode and/or status of the printing device 10.

The apparatus 10 includes a back plate generally indicated at 14, first, second, third and fourth printing assemblies generally indicated at 16, 18, 20 and 22, respectively, operable at first, second, third and fourth printing stations 24, 26, 28 and 30 for printing first, second, third and fourth colors onto each label of the web 12. Apparatus 10 also includes a feed assembly generally indicated at 32 for drawing the web 12 through the printing stations.

The apparatus 10 further includes first, second third and fourth printing film drive assemblies generally indicated at 36, 38, 40 and 42. During the operation of the apparatus 10, the printing film drive assemblies 36, 38, 40 and 42 are operated to supply first, second, third and fourth printing films 46, 48, 50 and 52 respectively, to the printing stations 24, 26, 28 and 30 and the stepping motor 34 is operated to advance the strip 12 in a substantially taut disposition between the printing stations. The controller 44 is responsive to a predetermined number of increments of an encoder 45, which tracks the position and speed of the labels on the web 12, for controlling the printing assemblies 16, 18, 20 and 22 to apply images of different colors to the labels mounted on web 12 so that the longitudinal positions of the images are precisely coordinated throughout the length of each label. Encoder 45 is of conventional design and therefore, its operation will not be described.

The web 12, as described above, preferably comprises a continuous strip of a plastic or paper-like substrate having a width of approximately 1 to 5 inches with a number of adhesive-backed labels (not shown) serially mounted thereon. While, in this description, the labels preferably have an adhesive backing for mounting to the web and then to a product after printing, it will be understood that the labels may be mounted to the web by any known means such as, for example, static electricity. The web 12 is preferably provided in a continuous roll 54 which is mounted on payoff roller 56 mounted to the back plate 14.

Figure 5:
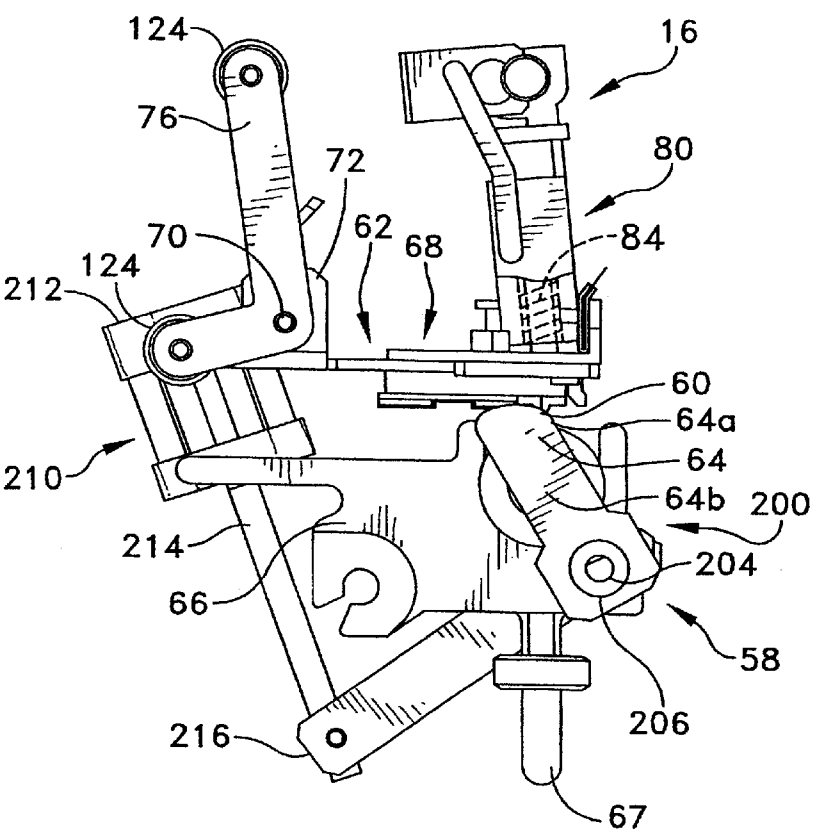
FIG. 5 is a front view of one printing assembly of the present invention, showing the head being biasedly engaged with the platen.
Figure 4:
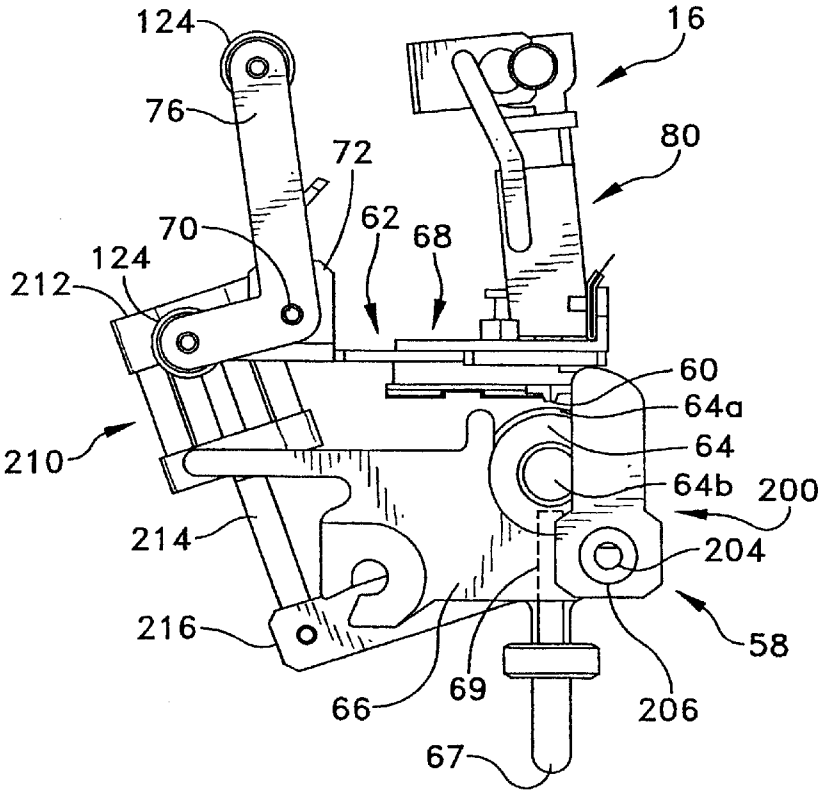
FIG. 4 is a front view of one printing assembly of the present invention, showing the head being lifted out of engagement with the platen.
Figure 6:
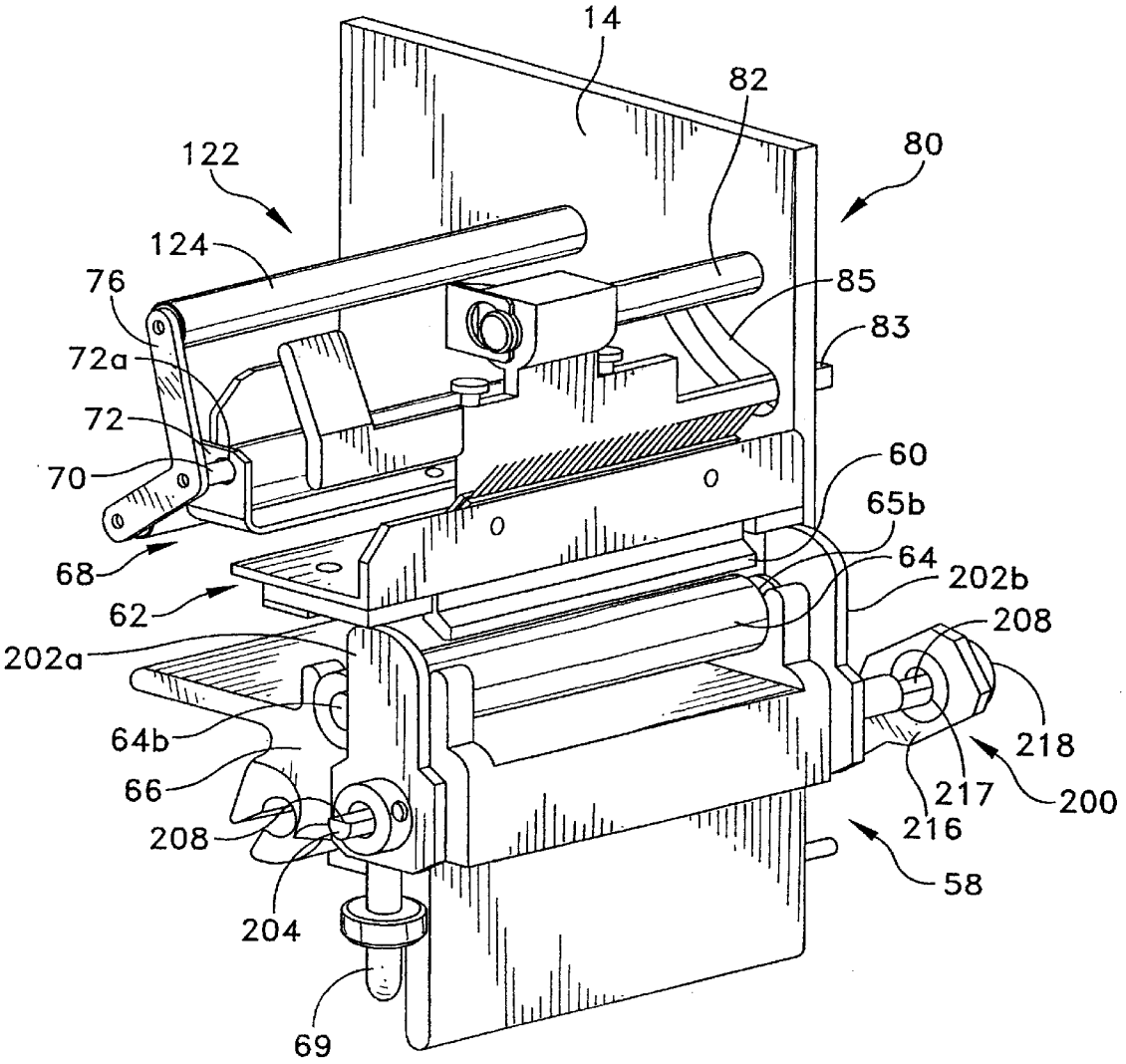
FIG. 6 is a front perspective view of one printing assembly of the present invention, showing the head being lifted out of engagement with the platen.
Figure 7:
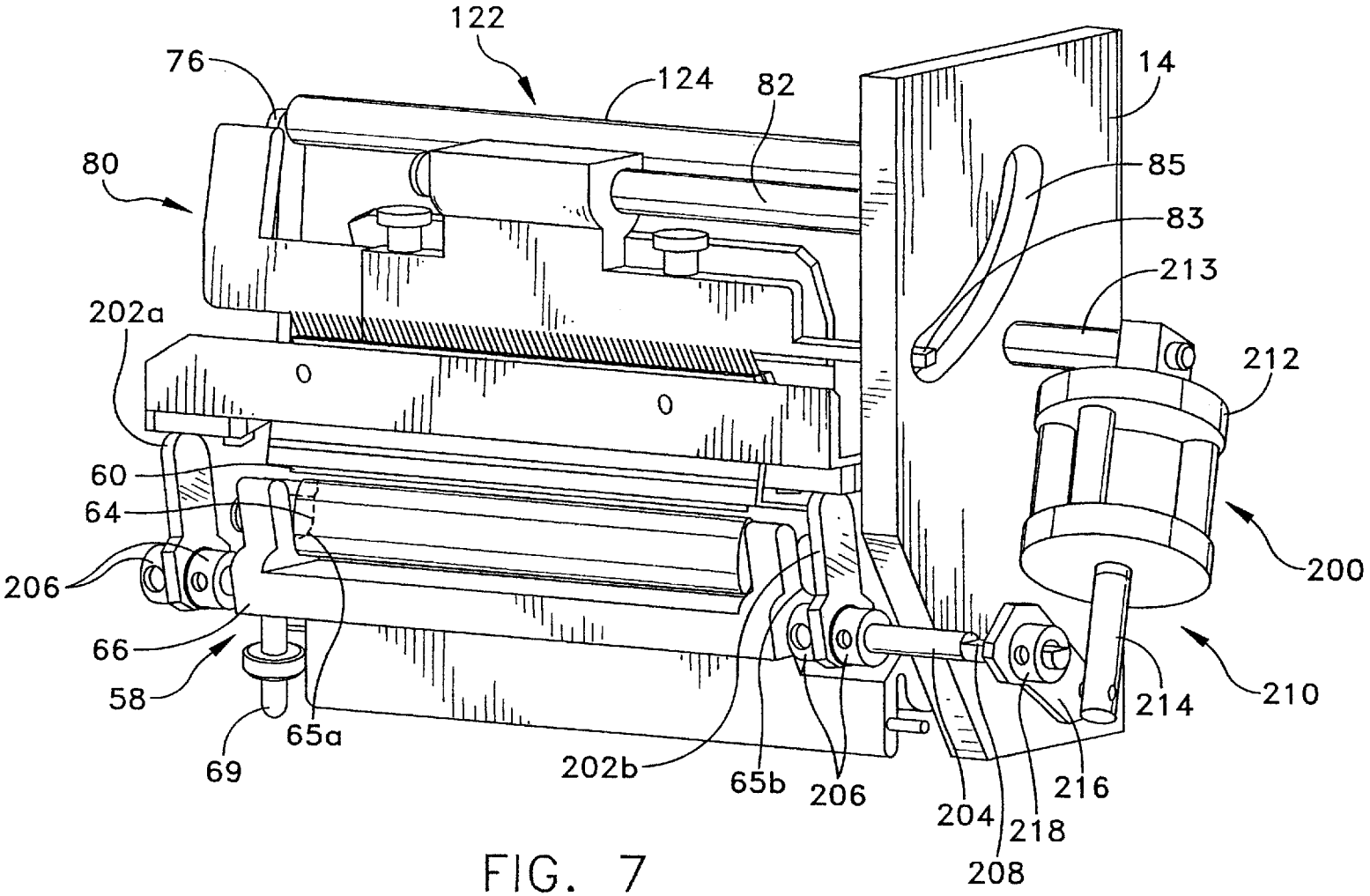
FIG. 7 is a rear perspective view of one printing assembly of the present invention, showing the head being lifted out of engagement with the platen.

The printing assemblies 16, 18, 20 and 22 will now be described in greater detail. Since all four printing assemblies are identical, only printing assembly 16, separately shown in FIGS. 4–7, will be described. FIGS. 4 and 5 are side views which show the printing assembly 16 without the back plate 14, while FIGS. 6 and 7 are front and rear perspective views of the printing assembly 16 showing a portion of the back plate 14 as it is attached to the printing assembly 16. Printing assembly 16 comprises an adjustable platen assembly generally indicated at 58, a thermal print head 60 and a thermal print head mounting assembly 62. The platen assembly 58 comprises a cylindrical platen 64 comprising a rubberized outer shell 64*a* and an axle 64*b* and a platen mounting bracket 66 which is mounted to the back plate 14 and is operative for rotatably receiving the platen 64 within a U-shaped outboard slot 65*a* and a U-shaped inboard slot 65*b*. The platen 64 is adjustably maintained in parallel relation to the print head 60 by a jack screw 67 which is threaded into an aperture 69, shown in phantom in FIG. 4, in platen mounting bracket 66. Aperture 69 opens into the bottom of slot 65*a* to allow jack screw 67 to adjust the position of axle 64*a* within outboard slot 65*a*. In order to maintain the platen 64 in a parallel relationship with the print head 60, the jack screw 67 is rotated to either raise or lower the outboard end of the platen 64 through contact with the axle 64*b*. Since the inboard end of the platen 64 is mounted in the inboard slot 65*b*, as the jack screw is rotated, the outboard end of platen 64 pivots in a vertical plane from the inboard slot 65*b* in order to level the platen so that it is parallel to the print head 60. Once the platen 64 is positioned parallel to the print head 60, it is locked in place by means of a locking device such as a lock nut which may be tightened against the bottom of the platen mounting bracket 66. This adjustability of the platen 64 is advantageous because, if the platen is not precisely parallel to the print head 60 during the printing process, the printing film will wrinkle as it passes between the print head 60 and the platen 64, causing deformities in the printed image, such as voids, streaks and smudging. The adjustable platen assembly 58 allows the placement of the platen 64 to be fine tuned in order to eliminate wrinkling of the printing film as it passes through the printing assembly.

The print head 60 preferably comprises a conventional thermal print head having an array of discretely energizable thermal elements. Energizing of the thermal elements is controlled by the controller 44 through conventional cable means (not shown).

The print head mounting assembly 62 is operative for mounting the print head 60 in substantially parallel relation to the platen 64 so that it is moveable between a media-loading position, shown by second printing assembly 18 in FIG. 3, where the print head 60 is lifted out of engagement with the platen 64, and an actuated position, shown by all print assemblies in FIG. 2, where the print head 60 is positioned in biased engagement with the platen 64. The print head mounting assembly 62 comprises a mounting bar indicated at 68 and a pivot bar 70 which is mounted to back wall 14. Mounting bar 68 includes an arm portion 74 which receives the print head 60 at the terminal end thereof. Mounting bar 68 also includes a pair of flanges 72 (only one of which is shown in the figures) having a hole 72*a* through which pivot bar 70 is mounted, between bracket 76 and back wall 14. Mounting bar 68 is mounted on pivot bar 70 to enable the print head mounting assembly 62 to be pivoted between the actuated position and the media-loading position, as will be described in greater detail below. The print head mounting assembly further comprises a pivotable toggle element generally indicated at 80 for maintaining the print head 60 in biased engagement with the platen 64. The toggle element 80 is pivotally mounted to the back plate 14 on a pin 82 at one end thereof, while the opposite end is pivotally movable into engagement with the terminal end of the arm portion 74 of the mounting bar 68. Movement of the toggle element 80 is guided by pin 83, which rides within arcuate slot 85 in back plate 14. More specifically, the toggle element 80 includes a spring mechanism 84 (broken lines) which engages the upper surface of the mounting bar 68. In this regard, the spring mechanism 84 urges the print head mounting assembly 62 downwardly into biased engagement with the platen 64. The terminal end of the mounting bar 68 includes a flange 86 for limiting forward movement of the toggle element 80, as shown by printing assembly 18 in FIG. 3.

Referring now to FIGS. 4 and 5, which show printing assembly 16 with the back plate 14 removed, and FIGS. 6 and 7, which are front and rear perspective views of printing assembly 16, the printing assembly 16 will be described in greater detail. Printing assembly 16 further includes a head lifting apparatus generally indicated at 200, which is mounted to platen assembly 58. Head lifting apparatus 200 comprises a pair of head lifting devices 202*a* and 202*b* which are mounted on a shaft 204 which passes through mounting bracket 66 such that head lifting devices 202*a* and 202*b* are disposed on opposite sides of the mounting bracket 66 and are held in place by a number of locknuts 206. Shaft 204 includes a flat surface 208 at either end thereof. Head lifting apparatus 200 also includes a piston mechanism 210, which includes a piston 212 which is mounted to the back side of back wall 14 by a pin 213 and which drives a rod 214. Rod 214 is pivotally mounted to a lever 216 having a hole 217 through which shaft 204 extends. The hole 217 of lever 216 has the same shape as the cross-sectional shape of shaft 204. In other words, the hole of lever 216 is mostly circular and has a flat edge which coincides with the flat edge 208 of shaft 204. This allows lever 216 to turn shaft 204 when the piston assembly 200 is activated, as will be described in greater detail below. Lever 216 is held in place on shaft 204 by a lock nut 218.

Referring back to FIG. 2, the feed assembly 32 is operative for advancing the web 12 through the apparatus 10 so that it passes through the first, second, third and fourth printing stations 24, 26, 28 and 30. More specifically, the feed assembly 32 comprises a drive assembly 98, a pressure roller 100 and a toggle element 102 for urging the pressure roller 100 into pressured engagement with the drive roller assembly 98. The drive assembly comprises a drive roller 104 having a rubberized outer shell and a mounting bracket 106 for mounting the drive roller to back plate 14. The pressure roller 100 includes a rubberized outer shell and is rotatably mounted in a bracket 108 which is pivotally mounted to back plate 14 by a pivot pin 110. The toggle element 102 is essentially identical to the previously described toggle elements 80 and it is pivotally moveable for urging the pressure roller 100 into biased engagement with the drive roller 104 so that when the drive roller 104 is rotated, the rollers 100 and 104 cooperate for advancing the web 12 through the apparatus 10.

The stepping motor 34 is drivingly coupled to the drive roller 104 via a drive belt and pulley arrangement (not shown). The stepping motor 34 is operative at a uniform rate of stepped rotational increments per revolution in order to insure precise longitudinal orientation of the different images applied to the labels on web 12 at the printing stations 24, 26, 28 and 30.

The first, second, third and fourth printing film drive assemblies 36, 38, 40 and 42 are operative for advancing their respective printing films 46, 48, 50 and 52 through the respective printing stations 24, 26, 28 and 30 so that the printing films pass between the respective print head 60 and the web 12. The printing films 46, 48, 50 and 52 comprise conventional thin polyester films having heat sensitive coating thereon, and they are responsive to heat from the thermal print heads 60 for transferring selected portions of the coatings thereon onto the labels on the web 12 to apply images or indicia to the labels. In the preferred embodiment each of the printing films 46, 48, 50 and 52 have a different color coating thereon, thereby enabling apparatus 10 to print in multiple colors. The printing films each preferably have a width of approximately 1 to 5 inches. The film drive assemblies 36, 38, 40 and 42 each comprise a film supply hub 118 containing a supply of film and a film take-up hub 120 and several guide rolls 121 and guide mechanisms, generally indicated at 122, for guiding the film into proper alignment into the printing station. Each guide mechanism 122 includes a pair of rollers 124 mounted between bracket 76 and back wall 14. The supply hubs 118 are rotatably mounted to the back plate 14 and include a resistance mechanism (not shown) for applying a slight resistance to rotation of the hub 118 to maintain the films in substantially taut condition as they are passed through the respective print station. The take-up hubs 120 are each rotatably mounted to back plate 14 and are drivingly coupled to drive motors (not shown) through a conventional gear pair (not shown). During operation of apparatus 10, the drive motors are operated in a stall condition to rotate the take-up hubs 120 in order to advance the films through the printing stations, while allowing the take-up hubs 120 to take up any slack in the films as the wound diameters of the take-up hubs 120 are increased in order to maintain substantially constant film speeds throughout the printing processes.

The controller 44 is operable in a conventional manner and includes a programmable microprocessor which can be programmed for control of the stepping motor 34, thermal print heads 60, the printing film drive assemblies 36, 38, 40 and 42, the head lifting apparatus 200. More specifically, the controller 44 is programmed so that it is responsive to a predetermined number of stepped rotational increments of the stepping motor 34 for coordinating the energization of the print heads 60 in the printing assemblies 16, 18, 20 and 22. The controller 44 actuates the printing assembly 16 to apply a first image in a first color to a label on the web 12 at the first printing station 24. While the printing assembly 16 is printing on the web 12, the printing head 60 is in the actuated position, shown in FIG. 5, where the print head 60 is positioned in biased engagement with the platen 64. This enables the print head to transfer the colored coating from the printing film onto the web 12. In this position, piston 212 is actuated, causing rod 214 of piston 212 to extend outwardly from piston 212. This causes lever 216 to rotate shaft 204 and head lifting devices 202*a* and 202*b* in a counterclockwise direction, causing head lifting devices 202*a* and 202*b* to controllably release printing head 60 into contact with the platen 64 due to the biasing force applied by spring mechanism 84. Since the spring mechanism 84 applies a constant, consistent biasing force to urge printing head 62 into engagement with platen 64, the printing head does not cause the printed label to be blurred or smudged. Controller 44 then actuates the head lifting apparatus 200 to lift the printing head 60 upwardly out of engagement with the platen 64, as shown in FIGS. 4, 6 and 7. This is done by deactivating the piston 212, causing rod 214 to be retracted into piston 212. This causes lever 216 to rotate shaft 204 and head lifting devices 202*a* and 202*b* clockwise. As head lifting devices 202*a* and 202*b* turn, they contact printing head mounting assembly 62 and lift printing head 60 out of engagement with the platen 64 against the bias force exerted by spring mechanism 84, as shown in FIGS. 4, 6 and 7. Once print head 60 has been lifted out of engagement with the platen 64, controller 44 stops the movement of the printing film drive assembly 36 in order to conserve the print film by advancing it through the printing assembly 16 only while the print assembly 16 is actually printing on the web 12. When it is necessary for printing assembly 16 to print, the print head 60 is returned to the actuated position, as described above, and the controller 44 resumes the advancement of printing film by printing film drive assembly 36. The printing assemblies 38, 40 and 42 are operated in the identical manner described above with reference to printing assembly 36.

FIG. 3 illustrates the apparatus 10 in each of its possible configurations. Printing assembly 16 is shown with the toggle element 80 removed and the head mounting assembly 62 rotated upward to allow access to the printing head 60 for cleaning. Printing assembly 18 is shown in the media loading position, with toggle element 80 pivoted away from the platen 64 to enable head mounting assembly 62 to be lifted away from the platen. This allows the printing film 48 and the web (not shown) to be loaded into printing assembly 18. Printing assembly 20 is shown in the non-actuated position, in which head lifting apparatus 200 maintains the printing head 60 out of engagement with the platen 64. Printing assembly 22 is shown in the actuated position, where head lifting apparatus 200 has released printing head 60 and spring mechanism 84 biases print head 60 into engagement with the platen 64.

It can be therefore seen that the instant invention provides a novel and effective apparatus 10 for printing multiple colors to labels on a web 12, while conserving the printing film by advancing the film through a particular printing apparatus only when that printing apparatus is to print on the label. The apparatus 10 includes four printing assemblies 16, 18, 20 and 22 which are individually operable for applying an image to the surface of a label on the web 12. Each printing assembly is movable between an actuated position in which the printing head is engaged with the platen 64 and a non-actuated position, in which the printing head 60 is lifted out of engagement with the platen 64. A head lifting apparatus 200 associated with each printing assembly is activated to lift the print head to the non-actuated position and to release the print head into the activated position. When a particular printing assembly is to print on a label on the web 12, it is released by the associated head lifting apparatus into biased engagement with the platen 64 and printing film is advanced across the print head to enable the transfer of ink onto the label from the printing film. When the printing assembly completes printing on the label, the head lifting apparatus lifts the head out of engagement with the platen and the advancement of the printing film is ceased. In this way, the printing film is only advanced through the printing assembly when the printing assembly is actually printing on a label, thereby greatly conserving the printing film.

While there is shown and described herein certain specific structure embodying the invention, it will be manifest to those skilled in the art that various modifications and rearrangements of the parts may be made without departing from the spirit and scope of the underlying inventive concept. For example, while, in the preferred embodiment, the apparatus 10 includes four printing assemblies, it can include any number of printing assemblies. Furthermore, while the head lifting apparatus 200 is described as being actuated by a piston, it will be understood that other actuation devices, such as direct drive motors and solenoids, could also be used in conjunction with the present invention. Accordingly, the inventive concept is not limited to the particular forms herein shown and described except insofar as indicated by the scope of the appended claims.

What is claimed is:

1. A printing assembly for printing an image on an article comprising:

an adjustable platen assembly including a platen having an inboard end and an outboard end;

a print head moveable between a first position in biased engagement with the platen and a second position out of engagement with the platen;

a jack member constructed and arranged to adjustably maintain the platen in parallel relation to the print head when the print head is in the first position;

wherein adjusting the jack member in a first direction raises one end of the platen and adjusting the jack member in a second direction lowers the one end of the platen in order to maintain the platen in parallel relation to the print head when the print head is in the first position, so as to prevent deformities in the printed image as the article passes through the printing assembly.

2. The printing assembly of claim 1, wherein the platen assembly includes an axle constructed and arranged to support the platen.

3. The printing assembly of claim 2, wherein the jack member contacts the axle so as to raise and lower the one end of the platen.

4. The printing assembly of claim 1, further comprising a platen mounting bracket having an inboard slot and an outboard slot, the platen being rotatably received within the inboard and outboard slots of the bracket.

5. The printing assembly of claim 4, wherein the mounting bracket includes an aperture constructed and dimensioned to receive the jack member therein, the jack member being received through the aperture and contacting a portion of the platen assembly as the jack member is moved toward the platen assembly.

6. The printing assembly of claim 5, wherein the platen is supported on an axle and the jack member contacts the axle in order to raise and lower the platen.

7. The printing assembly of claim 6, wherein the aperture is in communication with the outboard slot of the mounting bracket so that the jack member may be received through the aperture and outboard slot and contact the axle in order to raise and lower the outboard end of the platen.

8. The printing assembly of claim 7, wherein the inboard end of the platen remains substantially stationary as the jack member pivots the outboard end of the platen in a vertical plane from the inboard slot, so as to adjust the platen, parallel to the print head when the print head is in the first position.

9. The printing assembly of claim 5, wherein the jack member is a jack screw rotatable within the aperture.

10. The printing assembly of claim 4, wherein the inboard and outboard slots are generally U-shaped.

11. The printing assembly of claim 1, wherein the one end of the platen which is raised and lowered is the outboard end.

12. The printing assembly of claim 1, further comprising a locking device constructed and arranged to lock the platen in the position parallel to the print head when the print head is in the first position.

13. The printing assembly of claim 1, further comprising a print head mounting assembly constructed and arranged to support the print head and adapted to move the print head between the first position and the second position.

14. The printing assembly of claim 13, wherein the print head mounting assembly includes a mounting bar and a pivot bar.

15. The printing assembly of claim 1, wherein the print head is a thermal print head.

* * * * *